US005934125A

United States Patent [19]

Takayama

[11] Patent Number: 5,934,125

[45] Date of Patent: Aug. 10, 1999

[54] REFUGING SYSTEM FOR EMERGENCY OF TRANSFER FEEDER

[75] Inventor: Yukiyoshi Takayama, Komatsu, Japan

[73] Assignee: Kabushiki Kaisha Komatsu Seisakusho, Tokyo, Japan

[21] Appl. No.: 08/490,586

[22] Filed: Jun. 15, 1995

[30] Foreign Application Priority Data

Jul. 1, 1994 [JP] Japan ..... 6-150836

[51] Int. Cl.[6] ..... B21D 43/05; B21D 55/00

[52] U.S. Cl. ..... 72/1; 72/405.16; 72/405.13; 72/20.5; 72/21.3; 192/150

[58] Field of Search ..... 72/405.16, 405.13, 72/405.11, 405.01, 20.5, 20.1, 21.3, 1; 192/150

[56] References Cited

U.S. PATENT DOCUMENTS

| | | | |
|---|---|---|---|
| 3,746,184 | 7/1973 | Wallis | 72/405.13 |
| 4,627,253 | 12/1986 | Tennessen | 72/405.13 |
| 4,653,311 | 3/1987 | Tack | 72/405.11 |
| 4,702,363 | 10/1987 | Sofy | 192/150 |

FOREIGN PATENT DOCUMENTS

| | | |
|---|---|---|
| 1-313117 | 12/1989 | Japan . |
| 3-60824 | 3/1991 | Japan . |
| 4-83431 | 7/1992 | Japan . |
| 5-131231 | 5/1993 | Japan . |

*Primary Examiner*—Daniel C. Crane

*Attorney, Agent, or Firm*—Frishauf, Holtz, Goodman, Langer & Chick

[57] ABSTRACT

There is provided a refuging system for transfer bars of a transfer feeder of a transfer press, in which the transfer bars are driven by a transfer bar driving mechanism including an induction type servo motor. The refuging system includes a servo control for controlling the induction type servo motor, a detector for detecting an occurrence of an abnormal condition of the servo control and urgently stopping operations of a slide of a press body of the transfer press and the induction type servo motor, a detector for detecting a crank angle of the press body and discriminating an area in which the slide or a mold of the press body interfere with the transfer bar of the transfer feeder or an attachment therefor attached to the transfer bar, and a driver for driving the transfer bar to a position at which the slide and the mold of the press body do not interfere with the transfer bar of the transfer feeder and the attachment by applying an A.C. voltage to the induction type servo motor at a time when the operations of the slide and the induction type servo motor begin to be urgently stopped in the interference area.

7 Claims, 4 Drawing Sheets

REFUGING SYSTEM FOR EMERGENCY OF TRANSFER FEEDER

BACKGROUND OF THE INVENTION

The present invention relates to a refuging system for emergency of a transfer feeder provided for a transfer process.

A transfer press is equipped with a transfer feeder, and in the current technology of this art field, there are provided transfer feeders generally of two types, one being a cam drive type in which a transfer bar is driven in a two- or three-dimensional direction by a driving power from a driving source of a press body, and the other one being a servo-motor drive type in which the transfer bar is driven in a two- or three-dimensional direction by a servo-motor driven and rotated in synchronism with the operation of the press body. In the above two types, the servo-motor drive type can change a feed stroke and a lift stroke optionally, and accordingly, in recent years, the servo-motor drive type has been widely utilized.

When the servo-motor drive type transfer feeder is utilized, in a case where an abnormal condition is caused to the servo system and the transfer feeder is run away, it is necessary to urgently stop the operation of the transfer feeder or to refuge the same before transfer bars or attachments such as fingers secured to the transfer bars interfere with a slide or mold of a press body. Apparatus for preventing such interference of the transfer bars or attachments with the slide or mold are disclosed, for example, in the Japanese Patent Laid-open Publication No. HEI 1-313117. Japanese Patent Laid-open Publication No. HEI 3-360824. Japanese Patent Laid-open Publication No. HEI 5-131231, and Japanese Utility Model Laid-open Publication No. HEI 4-83431. Since the apparatus disclosed in these prior art documents all utilize the servo systems to control the refuging means, such interference as mentioned above cannot be avoided when the servo system is out of order, thus being inconvenient.

FIG. 1 shows an arrangement of a conventional servo control system, in which only single dimensional direction control is described, of a transfer feeder adopting the servo-motor drive type system described above. With reference to the arrangement of FIG. 1, reference numeral 1 denotes an NC controller for controlling positions of transfer bars of a transfer feeder 6 in synchronism with the operation of a press body, not shown. Positional information of a slide and a mold of the press body are detected through a press encoder 12 for detecting an angular position of a crank connected to the slide and the mold, and the movement of the transfer bar of the transfer feeder 6 to a predetermined position is performed and controlled in accordance with the thus detected positional information.

One motor of the transfer feeder 6 is driven by a servo amplifier 2 which supplies an electric current to the motor under control, and the servo amplifier 2 is driven by an electric drive source 3 which supplies a direct current to the servo amplifier 2.

Reference numeral 4 denotes an brake power source for urgently stopping a servo motor 7 in a case where an abnormal condition is caused to the servo amplifier 2 or the NC controller 1. The brake power source 4 supplies a direct current to the servo motor 7 for braking it at the occurrence of the abnormal condition.

Reference numeral 5 denotes a selector composed of a hard logic (logic circuit) which is switchable in accordance with the factors of the abnormality of the servo amplifier 2 or NC controller 1. The selector 5 usually selects the output (U. V. W) of the servo amplifier 2 and detects the output of the brake power source 4 at an occurrence of the abnormal condition to thereby supply the direct current to the servo motor 7 to brake the same. The servo motor 7 is a motor for driving the transfer feeder 6 in a certain dimensional direction, and therefore, an induction type servo motor is usually utilized as the servo motor 7.

The rotational speed of the servo motor 7 is detected by a sensor 8 and the rotational speed of the servo motor 7 detected by the sensor 8 is fed back to the servo amplifier 2.

The rotational angle position of the servo motor 7 is detected by a position incremental encoder 9 and then fed back to the NC controller 1.

Reference numeral 10 denotes an I/O module and reference numeral 11 denotes a sequencer. The sequencer 11 serves to exchange the information with the NC controller 1 via the I/O module, and for example, serves to set the motion of the transfer feeder 6 and monitor the conditions of the NC controller 1 and the servo amplifier 2.

The conventional servo control system of the structure described above will operate at the occurrence of the abnormal condition in the following manner.

The following factors will be mentioned as abnormal condition occurrence factors of the servo control system.

a. Generation of an abnormal signal from the servo amplifier 2.

b. Generation of a deviation abnormal signal from the NC controller 1 (signal representing a fact that an actual existing position with respect to a command position is larger than a prescribed value).

c. Run-away of the NC controller 1.

d. Electrical disconnection of the press encoder 12.

When such abnormal conditions occurs, the selector 5 is switched to the side of the brake power source 4, the D.C. voltage is applied to the induction type servo motor 7 for driving the transfer feeder 6, thereby urgently stopping the operation of the servo motor 7. At the same time, the slide of the press body is also urgently stopped. At this time, the sequencer 11 serves to memorize a fact that the abnormal condition occurs at what dimensional direction operation of the transfer feeder 6, and this abnormal condition is indicated to an operator through a display on the monitor, for example.

However, at the emergent operation stopping time, the transfer bar of the transfer feeder 6 and the slide or mold of the press body are independently stopped in their operations without synchronization thereamong, so that the transfer bar is first stopped and then the slide is stopped because of the difference in inertia magnitudes of the transfer bar and the slide and mold.

Because of such time lag for stopping the operations of the transfer bar of the transfer feeder 6 and the slide or mold of the press body, there may cause a case in which the slide or mold run away by the inertia interferes with the transfer bar or attachments mounted thereto, damaging the attachments or mold according to the stopped position of the transfer bar. Particularly, the mold is generally expensive, and accordingly, the damage of the mold may lead to the manufacturing cost increasing, and in addition, such time and labour will be required for the exchanging of the damaged mold with a new one, resulting in the lowering of the productivity of products, thus being also inconvenient.

SUMMARY OF THE INVENTION

An object of the present invention is to substantially eliminate defects or drawbacks encountered in the prior art described above and to provide a refuging system for an emergency of a transfer feeder in a transfer press capable of surely preventing an interference between a slide or mold of a press body and a transfer bar or attachments therefor in a case where the slide or mold and the transfer bar and the attachments are urgently stopped at an occurrence of an abnormal condition during a press working.

This and other objects of the present invention can be achieved by providing a refuging system for emergency of a transfer feeder in a transfer press having a transfer bar and a drive source for driving a transfer bar driving mechanism comprising an induction type servo motor, the refuging system comprising:

a servo control means for controlling the induction type servo motor;

means for detecting an occurrence of an abnormal condition of the servo control means and urgently stopping operations of a slide of a press body of the transfer press and the induction type servo motor;

means for detecting a crank angle of the press body and discriminating an area in which the slide or a mold of the press body interfere with the transfer bar of the transfer feeder or an attachments therefor attached to the transfer bar; and means for driving the transfer bar to a position at which the slide and the mold of the press body do not interfere with the transfer bar of the transfer feeder and the attachments by applying an A.C. voltage to the induction type servo motor at a time when the operation of the slide and the induction type servo motor begin to be urgently stopped in the interference area.

A preferred embodiment of the refuging system may further comprise means for switching a power source for the servo motor to a brake power source therefor so as to supply a D.C. of the brake power source to the induction type servo motor at a time when the transfer bar and the attachments therefor are refuged to the position at which the slide and the mold of the press body do not interfere with the transfer bar of the transfer feeder and the attachments.

A more concrete embodiment, there is provided a refuging system for emergency for a transfer feeder of a transfer press having a transfer bar and a drive source for driving a transfer bar for driving mechanism comprising an induction type servo motor, the refuging system comprising:

a servo control means for controlling the induction type servo motor, the servo control means comprising and NC controller for controlling a position of a transfer bar of a transfer feeder, a servo amplifier driven by a servo amplifier drive source and operatively connected to the NC controller for driving a motor of the transfer feeder for supplying an electric current to the motor, a brake power source for stopping the operation of the induction type servo motor at an occurrence of an abnormal condition of the NC controller or servo amplifier, and a selector operatively connected to the servo amplifier and the brake power source for switching an operation in accordance with a factor of the abnormal condition;

means for detecting the abnormal condition of the NC controller or servo amplifier;

a press encoder detecting a crank angle of the press body;

a sequencer operatively connected to the NC controller for communicating an information therebetween and discriminating a fact whether a slide or mold of the press body and the transfer bar or the attachments therefor are within an area in which they are interfered with each other or not; and a further selector operatively connected to the first mentioned selector and the commercial power source for selecting a driving mode of the induction type servo motor, the further selector being operatively connected to the sequencer.

In preferred embodiments of this aspect, the refuging system further comprises a digital rotary cam means disposed between the press encoder and the sequencer, wherein an interference crank angle of the press body at which the interference occurs is preliminarily set and a signal is generated from the digital rotary cam means to the sequencer only at a time when an emergency stop is caused within the interferences crank angle. The further selector is switched in response to a signal from the sequencer at a time when a signal representing an occurrence of the abnormal condition is generated from the digital rotary cam means to the sequencer.

The refuging system may further comprise a transformer disposed between the commercial power source and the further selector for applying an A.C. voltage stepped down from a rated voltage to the induction type servo motor, a pulse counter provided for the sequencer for detecting a rotational angle position of the induction type servo motor, and an incremental encoder provided for the induction type servo motor for feeding back the rotational angle position to the pulse counter to thereby detect the position of the transfer bar.

According to the present invention of the structure described above, when the operation of the servo motor is urgently stopped within the interference area of the slide or mold of the press body and the transfer bar or the attachments therefor, the A.C. voltage is applied to the servo motor to thereby refuge the transfer bar and the attachment to a portion at which they are not interfered with the slide and mold of the press body, thus preventing the mold, the attachment and the like from being interfered and damaged.

Furthermore, according to the preferred aspect of the present invention, since an A.C. voltage from the brake power source is applied to the servo motor before the transfer feeder is forcibly stopped by a stopper, an overload to be applied to the driving system can be effectively prevented.

BRIEF DESCRIPTION OF THE DRAWINGS

The present invention will become more understandable from the following detailed description an accompanying drawings representing an embodiment of the present invention. Further, it is to be noted that the embodiments shown in the accompanying drawings do not intend to specify the invention and merely intend to make easy the understanding of the invention.

In the accompanying drawings.

DESCRIPTION OF THE PREFERRED EMBODIMENT

Figure 1:
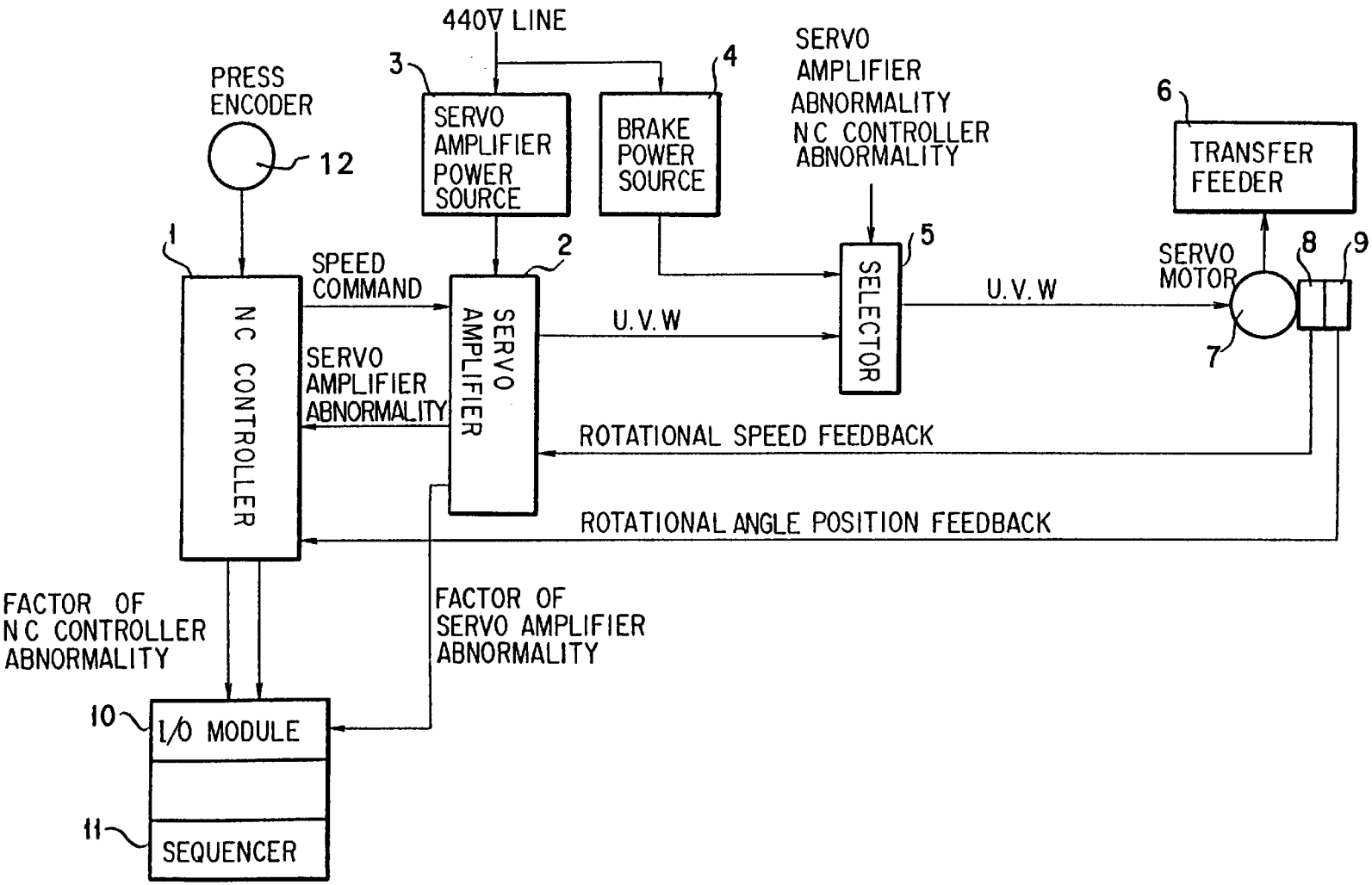
FIG. 1 is a block diagram of a servo control system of a transfer feeder of a conventional servo motor drive type structure.
Figure 2:
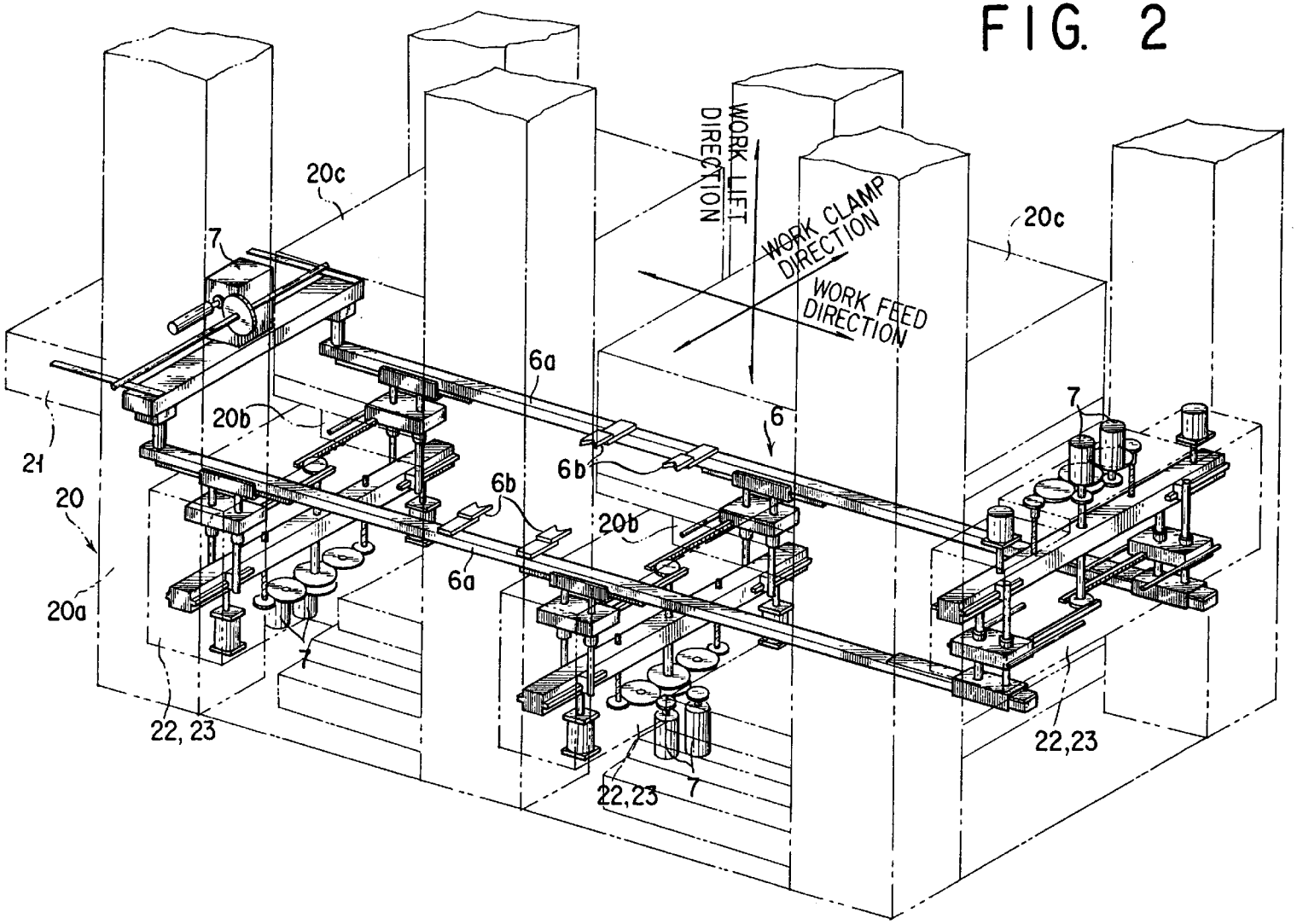
FIG. 2 is a perspective view of a transfer press provided with a servo motor drive type transfer feeder including an emergency refuging system according to one embodiment of the present invention.
Figure 3:
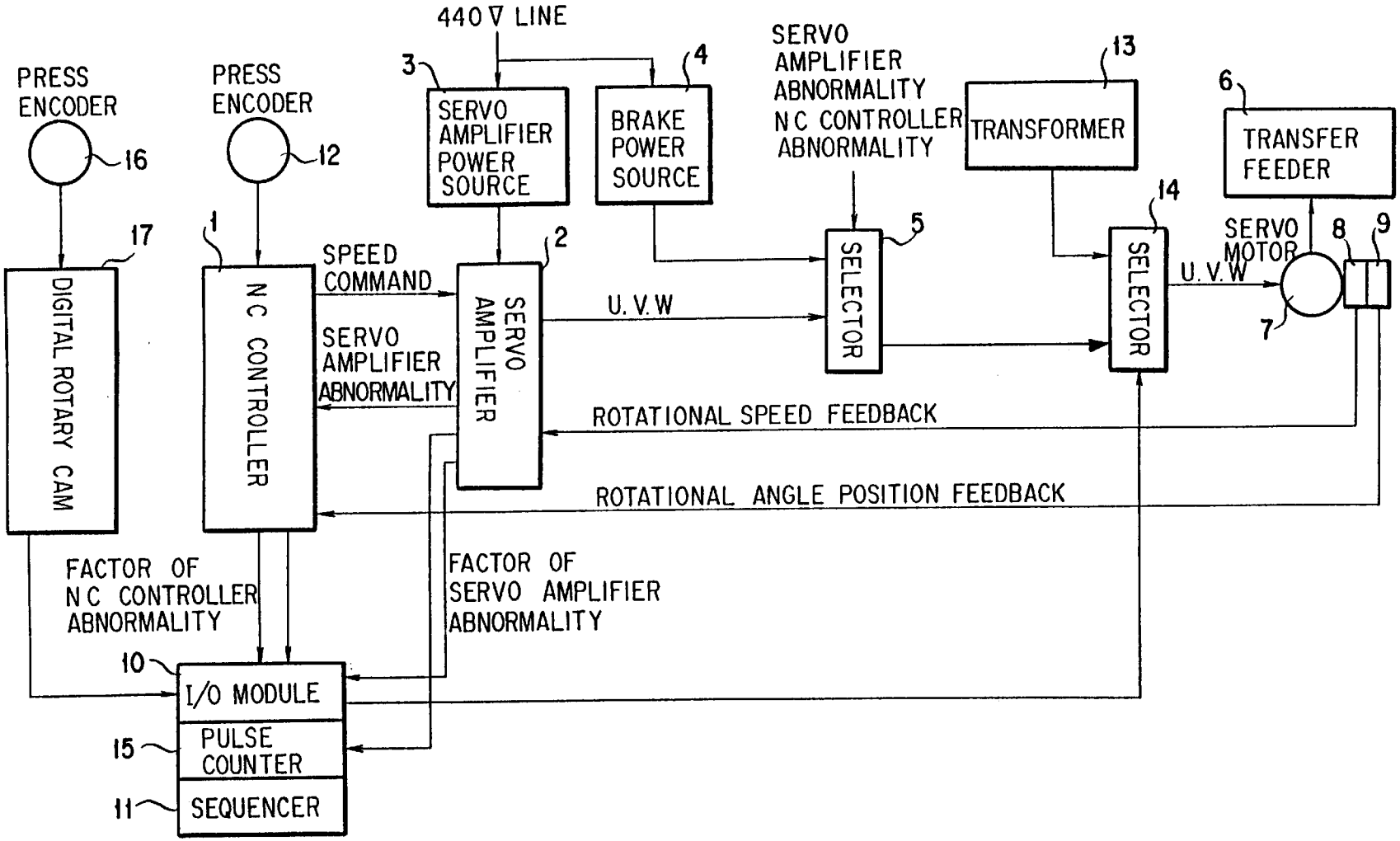
FIG. 3 is a block diagram of a servo control system of the servo motor drive type transfer feeder according to the present invention.
Figure 4:
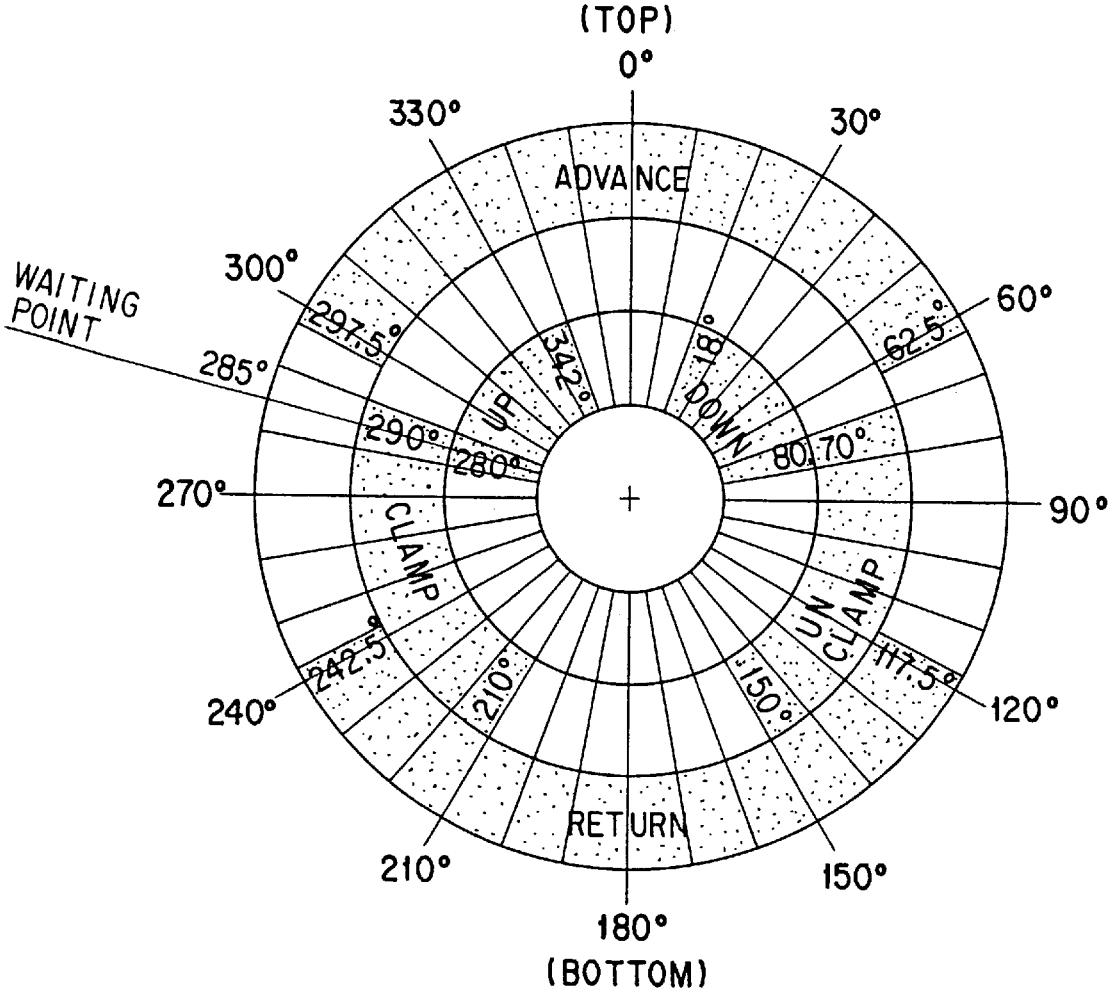
FIG. 4 is a view showing an operational relationship between the crank angle of the transfer press and the servo motor drive type transfer feeder including the present embodiment.

One embodiment of a refuging system for emergency of a transfer feeder according to the present invention will be described hereunder with reference to FIGS. 2 and 4, in which FIG. 2 is a perspective view of a transfer press provided with a servo motor drive type transfer feeder including an emergency refuging system of the present invention and FIG. 3 is a block diagram of a servo control system of the servo motor drive type transfer feeder of FIG. 2, and in which elements or portions of the servo control system corresponding to those shown in FIG. 1 are identified by the same reference numerals and the detailed explanations thereof are omitted hereunder.

With reference to FIG. 2, a press body 20 is provided with a mold 20*b* and a slide 20*c* for vertically moving the mold 20*b*. Also, the press body 20 is provided with front and rear uprights 20*a* between which a pair of transfer bars 6*1* of a transfer bar 6 are disposed in parallel with each other so as to extend in a feed direction of a work.

These transfer bars 6*a* are moved in the work feed direction by means of a feed mechanism 21, in a work lift direction by means of a lift mechanism 22 and in a work clamp direction by means of a clamp mechanism 23, respectively. The work is held by fingers, not shown, secured to these transfer bars 6*a* at opposing positions, respectively, thereby to subsequently transfer the work to respective working stations. The feed mechanism 21, the lift mechanism 22 and the clamp mechanism 23 are provided with induction type servo motors 7, respectively, which are controlled by a servo control system shown in FIG. 3.

The possibility that the slide 20*a* or mold 20*b* of the press body 20 interferes at the emergency stop time with the transfer bars 6*a* or attachments 6*b* therefor will be caused at a position of the transfer bars 6*a* in a case where an abnormal condition will be caused at a time when the transfer bars 6*a* set the work to the next station of the mold 20*b* and then unclamp the work. In such case, the crank angle is about 75°, corresponding to a position of lowering stroke of 40%, the slide 20*c* and the mold 20*b* are idly run by their inertias to bottom dead points, i.e., 180° crank angle position, even in the case of the emergency stop, and the mold 20*b* then interferes with the attachments 6*b* mounted to the transfer bars 6*a*. In a case of the crank angle being apart from about 75°, the transfer bars 6*a* are in an unclamping condition or the slide 20*c* and the mold 20*b* of the press body 20 are in a condition that they have been lifted, whereby such interference is not caused. Further, concerning a relationship between the crank angle of the press body 20 and the operational condition of the transfer bars 6*a* of the transfer feeder 6, a chart of FIG. 4 is to be referred to.

Accordingly, from the above disclosure, it will be said that the interference described above can be avoided by forcibly refuging the transfer bars 6*a* only in the clamp direction in the case where a certain abnormal condition is caused to the servo system at the crank angle 75° or near.

In view of the above recognition, according to the refuging system for emergency of the present invention, as shown in FIG. 3, a transformer 13, a selector 14, a pulse counter 15, a press encoder 16 and a digital rotary cam 17 are additionally incorporated to the conventional servo control system for controlling the transfer bars 6*a* in the clamp direction.

More in detail, the transformer 13 serves to apply, an A.C. voltage stepped down from a rated voltage, to the servo motor, and the selector 14 serves to select whether the driving of the servo motor 7 is performed directly through a commercial A.C. voltage or through the servo amplifier 2. The pulse counter 15 is provided for the sequencer 11 to detect the rotational angle position of the servo motor 7, the press encoder 16 serves to detect the crank angle, and the digital rotary cam 17 serves to set an output condition in an optional crank angle position. That is, as can be seen in comparison of the arrangement of FIG. 3 with that of FIG. 1, according to the embodiment of the present invention, these elements are additionally located to the emergency refuging system of FIG. 1.

The emergency refuging system of the present invention will operate in the following manner.

First, it is to be noted that the factors for causing the abnormalities of the servo control system are, as mentioned with respect to the prior technology, based on the abnormality of the servo amplifier 2, the deviation abnormality of the NC controller 1, the run-away of the NC controller 1, the electrical disconnection of the press encoder 12 or the like. When a signal informing such abnormality is generated, the selector 5 is switched to the brake power source 4 side by means of the hard logic, and the operation of the servo motor 7 is urgently stopped by the D.C. voltage applied by the brake power source 4, and at the same time, the slide 20*c* of the press body 20 is operated to also start its emergency stop operation.

In the next process, the sequencer 11 is operated to discriminate whether the slide 20*c* or the mold 20*b*, and the transfer bars 6*a* or the attachments 6*b* are in the area to be subjected to the interference with each other by the information of the crank angle inputted from the press encoder 16.

That is, the press encoder 16 is connected to the digital rotary cam 17, and the crank angle at which the transfer bars 6*a* of the transfer feeder 6 interfere with the slide 20*c* or mold 20*b* of the press body 20 is preliminarily set. When the emergency stop operation by the selector 5 begins within the interference crank angle, a signal is generated from the digital rotary cam 17, and on the other hand, in the case where the crank angle is in a range out of the interference crank angle, no signal is generated therefrom.

Accordingly, when the emergency stop operation by the selector 5 begins within the interference crank angle, the signal from the sequencer 11 is transmitted to the selector 14 connected to the digital rotary cam 17 and the selector 14 is switched. When, the A.C. voltage from the commercial A.C. power source is stepped down by the transformer 13 and applied to the servo motor 7 which is connected to the selector 14. However, since the induction type servo motor is utilized for this servo motor 7, the servo motor 7 is rotated by the applied A.C. voltage. Accordingly, the transfer feeder 6 is driven during the idle running of the slide 20*c* and the mold 20*b* of the press body by their inertias, and hence, the transfer bars 6*a* can be refuged to positions at which they do not interfere with the slide and the mold 20*b* of the press body 20.

Further, in a clamp direction, a mechanical stopper member is provided for an unclamp end of the transfer feeder 6 for preventing the transfer bars 6*a* from over running, but in a case where the servo motor 7 is driven after the forcible stopping of the transfer bars 6*a* through collision with the stopper member, an excessive force is applied to the driving system and the transfer bars 6*a* and they may be damaged.

In order to avoid an occurrence of such accident, according to the present invention, the following countermeasure is considered. That is, a signal from the incremental encoder 9 provided for the servo motor 7 for feeding back the rotational angle position signal is inputted into the pulse counter 15 provided for the sequencer 11 through the NC controller 1 to thereby count pulses of the signal, thus detecting the position of the transfer bars 6*a*.

When the face that the transfer bars 6*a* and the attachments 6*b* are refuged to positions not interfered with the slide 20*c* and the mold 20*b* of the press body 20 is detected, the selector 14 is switched to the output side of the servo amplifier 2. Then, the D.C. voltage is applied to the servo motor 7 by the brake power source 4 and the transfer bars 6*a* are hence stopped before they collide with the stopper member provided for the clamp shaft.

As described herinbefore, according to the present invention, the induction type servo motor 7 is utilized for the driving source of the transfer feeder 6, and the transfer bars 6*a* and the attachments 6*b* are refuged to positions being not interfered with the slide 20*c* and the mold 20*b* of the press body 20 by applying the A.C. voltage to the servo motor 7 after the beginning of the emergency stop operations of the press body 20 and the transfer feeder 6. Accordingly, the transfer bars 6*a* and the attachments 6*b* can be prevented from interfering with the slide 20*c* and the mold 20*b* and hence from being damaged.

Furthermore, since a fear of an expensive mold 20*b* being damaged can also be avoided, thus providing an economical merit and avoiding time and labour required for exchange of the damaged mold 20*b*, and hence, the lowering of the productivity can also be prevented, thus being advantageous.

It is to be noted that the present invention is not limited to the preferred embodiment described above and many other changed and modifications may be made without departing from the scope of the claims attached hereto.

What is claimed is:

1. A refuging system for emergency of a transfer feeder of a transfer press having a transfer bar and a drive source for driving a transfer bar driving mechanism comprising an induction type servo motor, the refuging system comprising:

a servo control means for controlling the induction type servo motor;

first means for detecting an occurrence of an abnormal condition of the servo control means and urgently stopping operations of a slide of a press body of the transfer press and the induction type servo motor;

second means for detecting a crank angle of the press body and discriminating an area in which the slide or a mold of the press body interfere with the transfer bar of the transfer feeder or an attachment therefor attached to the transfer bar; and third means, responsive to the second means, for driving the transfer bar to a position at which the slide and the mold of the press body do not interfere with the transfer bar of the transfer feeder and the attachment by applying an A.C. voltage to the induction type servo motor at a time when the operations of the slide and the induction type servo motor begin to be urgently stopped in the interference area.

2. A refuging system according to claim 1, further comprising means for switching a power source for the servo motor to a brake power source therefor so as to supply a D.C. of the brake power source to the induction type servo motor at a time when the transfer bar and the attachment therefor are refuged to the position at which the slide and the mold of the press body do not interfere with the transfer bar of the transfer feeder and the attachment.

3. A refuging system for emergency for a transfer feeder of a transfer press having a transfer bar and a drive source for driving a transfer bar driving mechanism comprising an induction type servo motor, the refuging system comprising:

a servo control means for controlling the induction type servo motor, said servo control means comprising an NC controller for controlling a position of a transfer bar of a transfer feeder, a servo amplifier supplied with a power from a servo amplifier power source and operatively connected to the NC controller for driving a motor of the transfer feeder for supplying an electric current to the motor, a brake power source for stopping the operation of the induction type servo motor at an occurrence of an abnormal condition of the NC controller or servo amplifier, and a selector operatively connected to the servo amplifier and the brake power source for switching an operation in accordance with a factor of the abnormal condition;

means for detecting the abnormal condition of the NC controller or servo amplifier;

a press encoder detecting a crank angle of the press body;

a sequencer operatively connected to the NC controller for communicating an information therebetween and discriminating a fact whether a slide or mold of the press body and the transfer bar or the attachment therefor are within an area in which they are interfered with each other or not; and a further selector operatively connected to the first mentioned selector and the commercial power source for selecting a driving mode of the induction type servo motor, said further selector being operatively connected to the sequencer.

4. A refuging system according to claim 3, further comprising a digital rotary cam means disposed between the press encoder and the sequencer, wherein an interferences crank angle of the press body at which the interference occurs is preliminarily met and a signal is generated from the digital rotary cam means to the sequencer only at a time when an emergency stop is caused within the interference crank angle.

5. A refuging system according to claim 4, wherein said further selector is switched in response to a signal from the sequencer at a time when a signal representing an occurrence of the abnormal condition is generated from the digital rotary cam means to the sequencer.

6. A refuging system according to claim 5, further comprising a transformer disposed between the commercial power source and the further selector for applying an A.C. voltage stepped down from a rated voltage to the induction type servo motor.

7. A refuging system according to claim 5, further comprising a pulse counter provided for the sequencer for detecting a rotational angle position of the induction type servo motor and an incremental encoder provided for the induction type servo motor for feeding back the rotational angle position to the pulse counter to thereby detect the position of the transfer bar.

* * * * *